US007609283B2

(12) United States Patent
Lee et al.

(10) Patent No.: US 7,609,283 B2
(45) Date of Patent: Oct. 27, 2009

(54) PLASMA DISPLAY APPARATUS AND IMAGE PROCESSING METHOD THEREOF

(75) Inventors: Jun Hak Lee, Suwon-si (KR); Dae Jin Myoung, Goyang-si (KR)

(73) Assignee: LG Electronics Inc., Seoul (KR)

( * ) Notice: Subject to any disclaimer, the term of this patent is extended or adjusted under 35 U.S.C. 154(b) by 595 days.

(21) Appl. No.: 11/133,412

(22) Filed: May 20, 2005

(65) Prior Publication Data

US 2005/0259046 A1 Nov. 24, 2005

(30) Foreign Application Priority Data

May 21, 2004 (KR) ..... 10-2004-0036510

(51) Int. Cl.
*G09G 5/10* (2006.01)

(52) U.S. Cl. ..... 345/690; 345/60; 345/68

(58) Field of Classification Search ..... 345/690, 345/60, 68

See application file for complete search history.

(56) References Cited

U.S. PATENT DOCUMENTS 7,256,755 B2 * 8/2007 Ohta et al. ..... 345/68
2003/0006994 A1 1/2003 Suzuki
2003/0193451 A1 10/2003 Kimura
2006/0145952 A1 * 7/2006 Takahashi ..... 345/60

FOREIGN PATENT DOCUMENTS

EP 1 160 757 A2 12/2001
EP 1 376 521 A1 1/2004
EP 1 585 091 A2 10/2005
EP 1 406 236 A3 6/2006

* cited by examiner

*Primary Examiner*—Richard Hjerpe
*Assistant Examiner*—Leonid Shapiro
(74) *Attorney, Agent, or Firm*—McKenna Long & Aldridge LLP

(57) ABSTRACT

The present invention relates to a plasma display apparatus and, more particularly, to a plasma display apparatus in which the ability to represent gray levels can be improved and halftone noise can be reduced by improving a plasma display apparatus and image processing method thereof. According to the present invention, the plasma display apparatus includes a motion detection unit that detects motion information of input image signal data, and a halftoning unit that halftones the image signal data by using at least one or more of a dithering method and an error diffusion method according to the motion information received from the motion detection unit.

12 Claims, 13 Drawing Sheets

Fig. 10

Halftone selection information table A

| Gray level | Motion 0 |
|---|---|
| 0 | Halftone method A0 |
| 1 | Halftone method A1 |
| 2 | Halftone method A2 |
| 3 | Halftone method A3 |
| 4 | Halftone method A4 |
| 5 | Halftone method A5 |
| ... | ... |
| 251 | Halftone method A251 |
| 252 | Halftone method A252 |
| 253 | Halftone method A253 |
| 254 | Halftone method A254 |
| 255 | Halftone method A255 |

Halftone selection information table B

| Gray level | Motion 1 |
|---|---|
| 0 | Halftone method B0 |
| 1 | Halftone method B1 |
| 2 | Halftone method B2 |
| 3 | Halftone method B3 |
| 4 | Halftone method B4 |
| 5 | Halftone method B5 |
| ... | ... |
| 251 | Halftone method B251 |
| 252 | Halftone method B252 |
| 253 | Halftone method B253 |
| 254 | Halftone method B254 |
| 255 | Halftone method B255 |

Halftone selection information table C

| Gray level | Motion 2 |
|---|---|
| 0 | Halftone method C0 |
| 1 | Halftone method C1 |
| 2 | Halftone method C2 |
| 3 | Halftone method C3 |
| 4 | Halftone method C4 |
| 5 | Halftone method C5 |
| ... | ... |
| 251 | Halftone method C251 |
| 252 | Halftone method C252 |
| 253 | Halftone method C253 |
| 254 | Halftone method C254 |
| 255 | Halftone method C255 |

Low gray level region

Fig. 13

Halftone selection information table a

| Gray level | Motion 0 |
|---|---|
| 0 | Halftone method a0 |
| 1 | Halftone method a1 |
| 2 | Halftone method a2 |
| 3 | Halftone method a3 |
| 4 | Halftone method a4 |
| 5 | Halftone method a5 |
| ... | ... |
| 251 | Halftone method a251 |
| 252 | Halftone method a252 |
| 253 | Halftone method a253 |
| 254 | Halftone method a254 |
| 255 | Halftone method a255 |

Halftone selection information table b

| Gray level | Motion 1 |
|---|---|
| 0 | Halftone method b0 |
| 1 | Halftone method b1 |
| 2 | Halftone method b2 |
| 3 | Halftone method b3 |
| 4 | Halftone method b4 |
| 5 | Halftone method b5 |
| ... | ... |
| 251 | Halftone method b251 |
| 252 | Halftone method b252 |
| 253 | Halftone method b253 |
| 254 | Halftone method b254 |
| 255 | Halftone method b255 |

Halftone selection information table c

| Gray level | Motion 2 |
|---|---|
| 0 | Halftone method c0 |
| 1 | Halftone method c1 |
| 2 | Halftone method c2 |
| 3 | Halftone method c3 |
| 4 | Halftone method c4 |
| 5 | Halftone method c5 |
| ... | ... |
| 251 | Halftone method c251 |
| 252 | Halftone method c252 |
| 253 | Halftone method c253 |
| 254 | Halftone method c254 |
| 255 | Halftone method c255 |

...

Low gray level region

...

Fig. 15

Halftone selection information table A(MOTION 0)

| Gray level | APL 0 | APL 1 | APL 2 | ... |
|---|---|---|---|---|
| 0 | Halftone method Aa0 | Halftone method Ab0 | Halftone method Ac0 | ... |
| 1 | Halftone method Aa1 | Halftone method Ab1 | Halftone method Ac1 | ... |
| 2 | Halftone method Aa2 | Halftone method Ab2 | Halftone method Ac2 | ... |
| 3 | Halftone method Aa3 | Halftone method Ab3 | Halftone method Ac3 | ... |
| 4 | Halftone method Aa4 | Halftone method Ab4 | Halftone method Ac4 | ... |
| 5 | Halftone method Aa5 | Halftone method Ab5 | Halftone method Ac5 | ... |
| ... | ... | ... | ... | ... |
| 251 | Halftone method Aa251 | Halftone method Ab251 | Halftone method Ac251 | ... |
| 252 | Halftone method Aa252 | Halftone method Ab252 | Halftone method Ac252 | ... |
| 253 | Halftone method Aa253 | Halftone method Ab253 | Halftone method Ac253 | ... |
| 254 | Halftone method Aa254 | Halftone method Ab254 | Halftone method Ac254 | ... |
| 255 | Halftone method Aa255 | Halftone method Ab255 | Halftone method Ac255 | ... |

Halftone selection information table B(MOTION 0)

| Gray level | APL 0 | APL 1 | APL 2 | ... |
|---|---|---|---|---|
| 0 | Halftone method Ba0 | Halftone method Bb0 | Halftone method Bc0 | ... |
| 1 | Halftone method Ba1 | Halftone method Bb1 | Halftone method Bc1 | ... |
| 2 | Halftone method Ba2 | Halftone method Bb2 | Halftone method Bc2 | ... |
| 3 | Halftone method Ba3 | Halftone method Bb3 | Halftone method Bc3 | ... |
| 4 | Halftone method Ba4 | Halftone method Bb4 | Halftone method Bc4 | ... |
| 5 | Halftone method Ba5 | Halftone method Bb5 | Halftone method Bc5 | ... |
| ... | ... | ... | ... | ... |
| 251 | Halftone method Ba251 | Halftone method Bb251 | Halftone method Bc251 | ... |
| 252 | Halftone method Ba252 | Halftone method Bb252 | Halftone method Bc252 | ... |
| 253 | Halftone method Ba253 | Halftone method Bb253 | Halftone method Bc253 | ... |
| 254 | Halftone method Ba254 | Halftone method Bb254 | Halftone method Bc254 | ... |
| 255 | Halftone method Ba255 | Halftone method Bb255 | Halftone method Bc255 | ... |

PLASMA DISPLAY APPARATUS AND IMAGE PROCESSING METHOD THEREOF

CROSS-REFERENCE TO RELATED APPLICATIONS

This Nonprovisional application claims priority under 35 U.S.C. § 119(a) on patent application Ser. No. 10-2004-0036510 filed in Korea on May 21, 2004, the entire contents of which are hereby incorporated by reference.

BACKGROUND OF THE INVENTION

1. Field of the Invention

The present invention relates to a plasma display apparatus and, more particularly, to a plasma display apparatus in which the ability to represent gray levels can be improved and halftone noise can be reduced by improving a plasma display apparatus and image processing method thereof.

2. Background of the Related Art

Generally, a plasma display apparatus includes a plasma display panel in which a barrier rib formed between a front substrate and a rear substrate form one unit cell. Each cell is filled with a main discharge gas such as neon (Ne), helium (He) or a mixed gas (Ne+He) of Ne and He, and an inert gas containing a small amount of xenon. If the inert gas is discharged with a high frequency voltage, it generates vacuum ultraviolet rays, and light-emits phosphors formed between the barrier ribs, thereby implementing an image. This plasma display apparatus can be made thin and slim, and thus has been in the spotlight as next-generation display devices.

FIG. 1 is a perspective view illustrating the construction of a conventional plasma display panel.

As shown in FIG. 1, the plasma display panel includes a front substrate 100 and a rear substrate 110, which are combined parallel to each other. In this case, in the front substrate 100, a plurality of sustain electrode pairs in which scan electrodes 102 and sustain electrodes 103 are formed in pairs is arranged in a front glass 101 used as a display surface on which an image is displayed. Further, in the rear substrate 110, a plurality of address electrodes 113 are arranged on a rear glass 111 forming a rear surface in such a manner that they cross the plurality of the sustain electrode pairs.

The front substrate 100 is covered with one or more dielectric layers 104. The dielectric layers 104 serves to limit a discharge current of the scan electrodes 102 and the sustain electrode 103 for performing a discharge mutually and maintaining emission of a cell in one discharge cell, i.e., the scan electrodes 102 and the sustain electrode 103 each having a transparent electrode (a) made of a transparent ITO material and a bus electrode (b) made of a metal material, and to insulate electrode pairs. A protection layer 105 on which magnesium oxide (MgO) is deposited in order to facilitate the discharge condition is formed on the entire dielectric layer 104.

In the rear substrate 110, barrier ribs 112 having the form of a stripe (or a well type) for defining a plurality of discharge spaces, i.e., discharge cells are arranged in a parallel manner. Further, a plurality of address electrodes 113 that performs an address discharge is disposed parallel to the barrier ribs 112. R, G and B phosphors 114 that emit visible ray for image display upon address discharging are coated on a top surface of the rear substrate 110. A lower dielectric layer 115 for protecting the address electrodes 113 is formed between the address electrodes 113 and the phosphors 114.

FIG. 2 is a view for explaining a method of implementing an image of a plasma display apparatus in the prior art.

As shown in FIG. 2, the plasma display apparatus is adapted to implement an image in such a manner that one frame period is divided into a plurality of sub-fields having a different frequency of emission and a plasma display panel is light-emitted in a sub-field period corresponding to a gray level value of an input picture signal.

Each of the sub fields is divided into a reset period for uniformly generating discharging, an address period for selecting a discharge cell, and a sustain period for implementing gray levels according to the number of discharging. For example, if it is desired to display an image with 256 gray scales, a frame period (16.67 ms) corresponding to 1/60 seconds is divided into eight sub-fields.

Furthermore, each of the eight sub-fields is subdivided into a reset period, an address period and a sustain period. In this case, the sustain period increases in the ratio of $2^n$ (where, n=0, 1, 2, 3, 4, 5, 6, 7) in each of the sub-fields. As such, since the sustain period varies in each sub-field, gray levels of an image can be implemented.

FIG. 3 is a graph showing a comparison result of brightness characteristics between a plasma display apparatus and a cathode-ray tube (CRT).

As shown in FIG. 3, a CRT and a liquid crystal display (LCD) represent a desired gray level by controlling displayed light in the analog mode according to an input video signal, and thus generally have non-linear brightness characteristics. To the contrary, a plasma display apparatus represents a gray level by modulating the number of optical pulses using the matrix array of a discharge cell that can be turned on/off, and thus has linear brightness characteristics. The gray level representation method of this plasma display apparatus is called a "pulse width modulation (PWM) method".

In this case, in the display apparatus such as a CRT, a display current versus brightness characteristics is proportional to a 2.2 multiplier. An external input image signal such as a broadcasting signal transmits a signal corresponding to an opposite of the 2.2 multiplier. Accordingly, in the plasma display apparatus having linear brightness characteristics, an external input image signal needs to undergo inverse gamma correction.

FIG. 4 is a graph showing inverse gamma correction in the conventional plasma display apparatus.

In FIG. 4, a target brightness indicates an ideal inverse gamma result to be corrected, an actual brightness indicates a measured brightness value, which is shown as a result of inverse gamma correction, and a PDP brightness indicates below brightness value 3, which is measured in a state in which inverse gamma correction does not exist.

As shown in FIG. 4, in the target brightness, 61-step gray level values from 0 to 60 are represented as different brightness values, respectively. To the contrary, in the actual brightness, 61-step gray level values from 0 to 60 are represented as different as only eight brightness values. Accordingly, when inverse gamma correction is performed in the plasma display apparatus, gray levels are not sufficiently represented in a dark region. Therefore, there is a problem in that a pseudo contour in which images look united is generated.

In order to represent short gray levels of the plasma display apparatus, a halftone method, such as a dithering method and an error diffusion method, has been used.

The dithering method will be first described with reference to FIGS. 5*a* and 5*b*.

FIGS. 5*a* and 5*b* are views illustrating the dithering method of the plasma display panel in the prior art. FIG. 5*a* shows a conventional 2×2 dither mask, and FIG. 5*b* shows dither mask patterns by the 2×2 dither mask.

As shown in FIGS. 5*a* and 5*b*, the dithering method is a method in which whether to generate a carry is determined by comparing a gray level value of each pixel with a predetermined threshold value of a dither mask. In this case, this method is designed to increase the ability to represent gray levels by turning on pixels in which a carry is generated, and turning off pixels in which a carry is not generated.

Furthermore, the dithering method is a method in which adequate noise is added so that pseudo contour is invisible with the naked eye. In the prior art, three-dimensional dither mask patterns corresponding to a number of frames, a number of lines and a number of columns of a plasma display panel are repeatedly used.

However, the dithering method has a problem in that dithering noise to reduce the picture quality in a predetermined gray level is generated. There is also a problem in that error indicating how much is a carry greater or smaller than a threshold value when generating the carry is never taken into consideration.

The error diffusion method will now be described with reference to FIG. 6.

FIG. 6 is a view illustrating the error diffusion method of the plasma display apparatus in the prior art.

As shown in FIG. 6, the error diffusion method is a method in which correction for abandoned error is spatially solved by allowing error generated when a corresponding pixel is quantized to affect neighboring pixels.

In this case, the error diffusion method includes multiplying predetermined coefficients to error values, which are generated in picture signals a, b, c and d of neighboring pixels. The error values multiplied by the coefficients are added to i values and then undergo quantization. The error values resulting from the quantization are then stored in a line memory and are repeated every pixel.

Meanwhile, in the error diffusion method, one-way diffusion is performed on a cell and line basis. This results in problems that diffusion patterns having the directivity are generated and error diffusion patterns are accumulated in a predetermined gray level.

In order to solve the problems of the halftone method, a method in which dithering and error diffusion are selectively used according to a gray level value of input image signal data was attempted, as shown in FIG. 7.

FIG. 7 is a block diagram showing a conventional halftoning unit.

Referring to FIG. 7, the conventional halftoning unit 700 includes a halftone selection information table storage unit 710, a selection unit 720 and a halftoning processing unit 730.

The halftone selection information table storage unit 710 of each gray level stores information on which one of three kinds of halftone methods will be used according to a gray level value of input image signal data.

The selection unit 720 selects image signal data, which are processed by means of a halftone method corresponding to information output from the halftone selection information table storage unit 710. In this case, the selection unit 720 can be substantially implemented using a multiplexer (MUX).

In this case, the three kinds of the halftone methods include the error diffusion method, the dithering method and a mixed method of error diffusion and dithering. These three kinds of the halftone methods are performed by means of the halftoning processing unit 730 having an error diffusion unit 731, a dithering unit 732 and an error diffusion/dithering unit 733.

Meanwhile, the respective halftone methods used in the conventional halftoning unit have different properties in the case of a still image and in the case of a motion picture. That is, if a motion image signal is halftoned by means of a halftone method capable of reducing halftone noise generated in a still image, there is a problem in that halftone noise generated in the motion picture increases. To the contrary, if a still image signal is halftoned by means of a halftone method capable of reducing halftone noise generated in a motion picture, there is a problem in that halftone noise generated in the still image increases.

Furthermore, the respective halftone methods have different characteristics according to the brightness of the whole screen on a frame basis. For example, there is a problem in that dither noise increases more in a dark screen than in a bright screen.

SUMMARY OF THE INVENTION

Accordingly, the present invention has been made in view of the above problems occurring in the prior art, and it is an object of the present invention to provide a plasma display apparatus and image processing method thereof, in which the picture quality can be improved by using a halftone method suitable for a motion or an APL value of a screen displayed.

To achieve the above object, according to a first embodiment of the present invention, there is provided a plasma display apparatus, including a motion detection unit that detects motion information of input image signal data, and a halftoning unit that halftones the image signal data by using at least one or more of a dithering method and an error diffusion method according to the motion information received from the motion detection unit.

The motion detection unit of the present invention can detect whether a motion exists or one or more information of the motion degree by comparing gray level values of image signal data corresponding to respective cells in at least two or more consecutive frames.

The motion detection unit of the present invention can detect whether a motion exists or one or more information of the motion degree by measuring variations in a turn on or off state of each cell in at least two or more consecutive frames.

The halftoning unit of the present invention can include a first selection unit that selects a halftone method according to the motion information, a halftoning processing unit that halftones the image signal data using each of the methods, and a second selection unit that selects and outputs image signal data, which are processed in the halftoning processing unit, according to information received from the first selection unit.

According to the present invention, different halftone methods can be set according to gray level values of the input image signal data.

According to the present invention, different halftone methods can be set to the same gray level value of image signal data according to the motion information.

The gray level value of the present invention can be a predetermined threshold value or less, the image signal data are halftoned by means of the error diffusion method.

According to the present invention, the greater the motion degree of motion information of the image signal data becomes, the higher the predetermined threshold value becomes.

The plasma display apparatus can further include a halftone selection information table storage unit that previously stores at least two or more halftone selection information tables in which halftone methods are set according to the motion information or any one or more information of gray level values of image signal data.

According to a first embodiment of the present invention, there is provided an image processing method of a plasma display apparatus, including a motion detection step of detecting motion information of input image signal data, and a halftoning step of halftoning the image signal data by using at least one or more methods of a dithering method and an error diffusion method according to the motion information received in the motion detection step.

The motion detection step of the present invention can include detecting whether a motion exists or one or more information of the motion degree by comparing gray level values of image signal data corresponding to respective cells in at least two or more consecutive frames.

The motion detection step of the present invention can include detecting whether a motion exists or one or more information of the motion degree by measuring variations in a turn on or off state of each cell in at least two or more consecutive frames.

The halftoning step of the present invention can include a first selection step that selects a halftone method according to the motion information, a halftoning processing step that halftones the image signal data using each of the methods, and a second selection step that selects and outputs image signal data, which are processed in the halftoning processing step, according to information received from the first selection step.

According to the present invention, different halftone methods are set according to gray level values of the input image signal data.

According to the present invention, different halftone methods are set with respect to the same gray level value of image signal data according to the motion information.

According to the present invention, the gray level value can be a predetermined threshold value or less, the image signal data are halftoned by means of the error diffusion method.

According to the present invention, the greater the motion degree of motion information of the image signal data becomes, the higher the predetermined threshold value becomes.

The image processing method of the present invention can further include a halftone selection information table storage unit that previously stores at least two or more halftone selection information tables in which halftone methods are set according to the motion information or any one or more information of gray level values of image signal data.

According to a second embodiment of the present invention, there is provided a plasma display apparatus, including an APL (Average Picture Level) detection unit that detects APL information of input image signal data, and a halftoning unit that halftones the image signal data by using at least one or more of a dithering method and an error diffusion method according to the APL information received from the APL detection unit.

The APL detection unit of the present invention can detect the APL information by calculating an APL value of a gray level value of image signal data corresponding to the entire cells on a frame basis.

The halftoning unit of the present invention can include a first selection unit that selects a halftone method according to the APL information, a halftoning processing unit that halftones the image signal data using each of the methods, and a second selection unit that selects and outputs image signal data, which are processed in the halftoning processing unit, according to information received from the first selection unit.

According to the present invention, different halftone methods can be set according to gray level values of the input image signal data.

According to the present invention, different halftone methods can be set to the same gray level value of image signal data according to the APL information.

According to the present invention, the gray level value can be a predetermined threshold value or less, the image signal data are halftoned by means of the error diffusion method.

According to the present invention, the lower an APL value of the APL information of the image signal data becomes, the higher the predetermined threshold value becomes.

According to the present invention, the plasma display apparatus can further include a halftone selection information table storage unit that previously stores at least two or more halftone selection information tables in which halftone methods are set according to the APL information or any one or more information of gray level values of image signal data.

According to a second embodiment of the present invention, there is provided an image processing method of a plasma display apparatus, including an APL (Average Picture Level) detection step that detects APL information of input image signal data, and a halftoning step that halftones the image signal data by using at least one or more of a dithering method and an error diffusion method according to the APL information received from the APL detection step.

The APL detection step of the present invention can include detecting the APL information by calculating an APL value of a gray level value of image signal data corresponding to the entire cells on a frame basis.

The halftoning step of the present invention can include a first selection step that selects a halftone method according to the APL information, a halftoning processing step that halftones the image signal data using each of the methods, and a second selection step that selects and outputs image signal data, which are processed in the halftoning processing step, according to information received from the first selection step.

According to the present invention, different halftone methods can be set according to gray level values of the input image signal data.

According to the present invention, different halftone methods can be set to the same gray level value of image signal data according to the APL information.

According to the present invention, when the gray level value is a predetermined threshold value or less, the image signal data are halftoned by means of the error diffusion method.

According to the present invention, the lower an APL value of the APL information of the image signal data becomes, the higher the predetermined threshold value becomes.

According to the present invention, the image processing method can further include a halftone selection information table storage step that previously stores at least two or more halftone selection information tables in which halftone methods are set according to the APL information or any one or more information of gray level values of image signal data.

According to a third embodiment of the present invention, there is provided a plasma display apparatus, including a motion detection unit that detects motion information of input image signal data, an APL detection unit that detects APL (Average Picture Level) information of the image signal data, and a halftoning unit that halftones the image signal data by using at least one or more methods of a dithering method and an error diffusion method according to the motion information and the APL information.

According to a third embodiment of the present invention, there is provided an image processing method of a plasma display apparatus, including a motion detection step that detects motion information of input image signal data, an APL detection step that detects APL (Average Picture Level) information of the image signal data, and a halftoning step that halftones the image signal data by using at least one or more methods of a dithering method and an error diffusion method according to the motion information and the APL information.

BRIEF DESCRIPTION OF THE DRAWINGS

Further objects and advantages of the invention can be more fully understood from the following detailed description taken in conjunction with the accompanying drawings in which:

FIG. 10 is a view for explaining halftone selection information tables according to a first embodiment of the present invention;

FIG. 13 is a view for explaining halftone selection information tables according to a second embodiment of the present invention;

FIG. 15 is a view for explaining halftone selection information tables according to a third embodiment of the present invention.

DETAILED DESCRIPTION OF THE PREFERRED EMBODIMENT

The present invention will now be described in detail in connection with preferred embodiments with reference to the accompanying drawings.

First Embodiment

Figure 1:
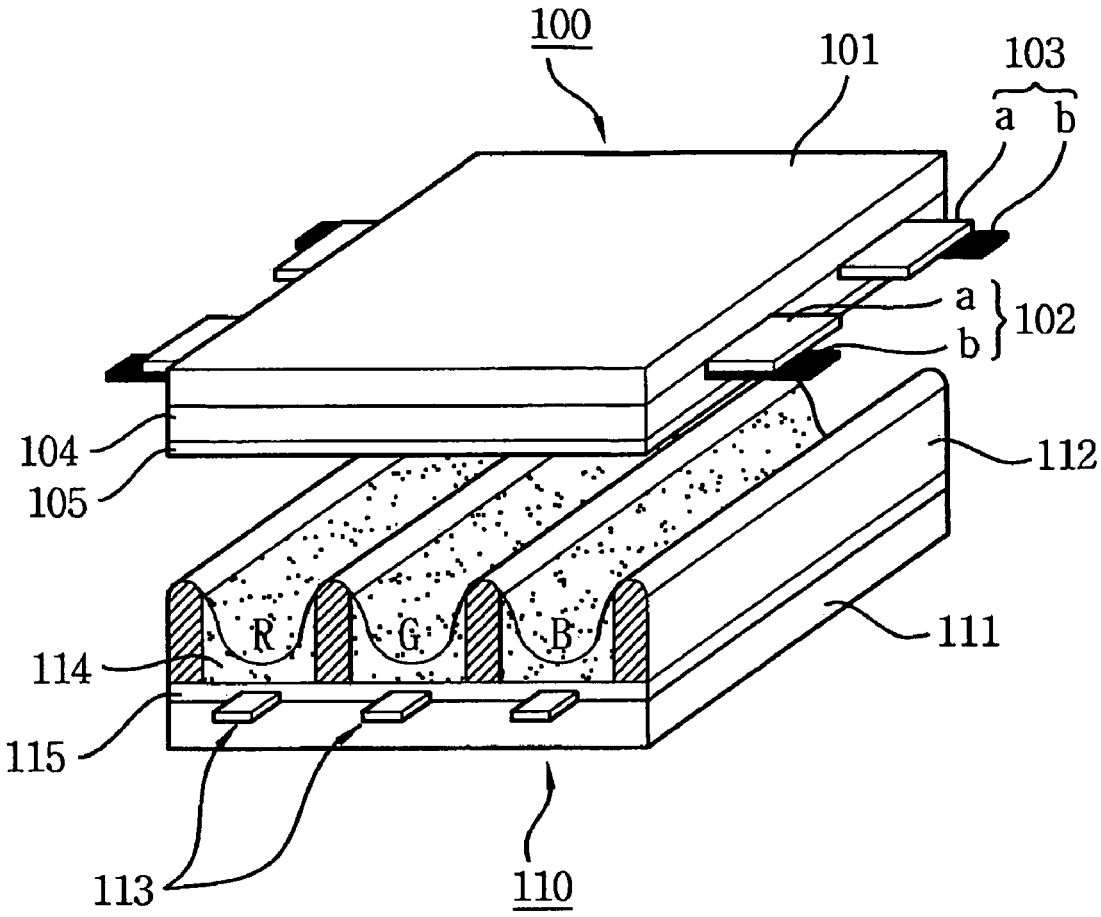
FIG. 1 is a perspective view illustrating the construction of a conventional plasma display panel.
Figure 2:
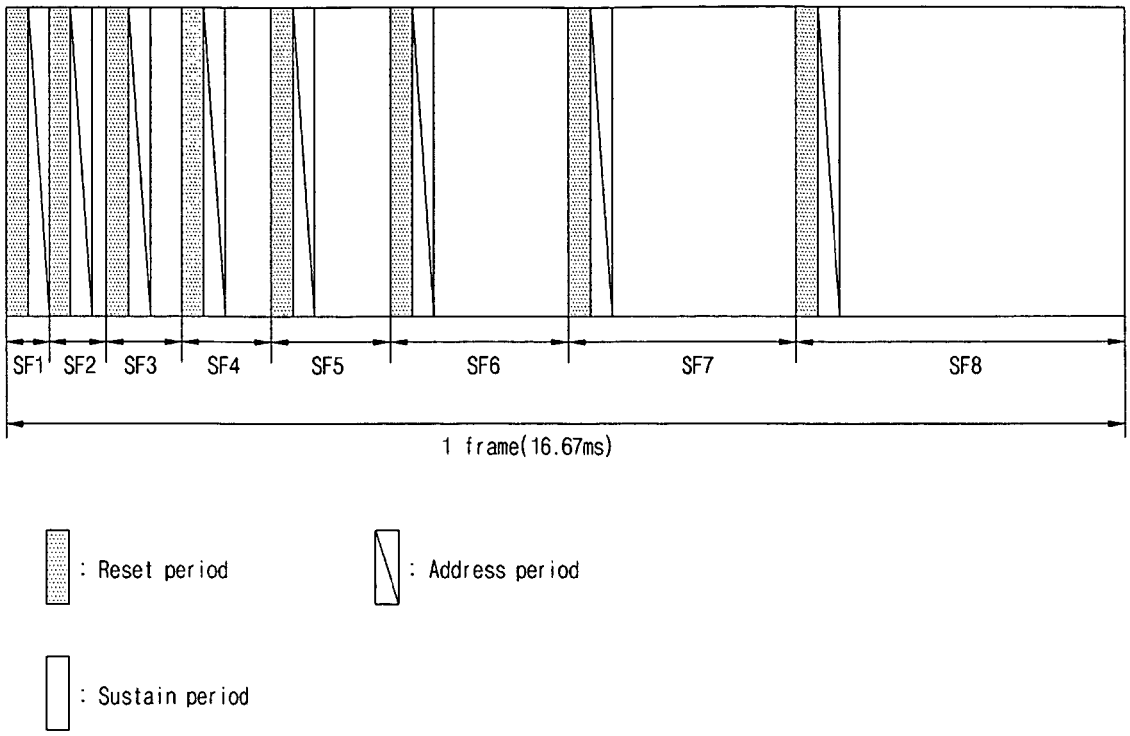
FIG. 2 is a view for explaining a method of implementing an image of a plasma display apparatus in the prior art.
Figure 3:
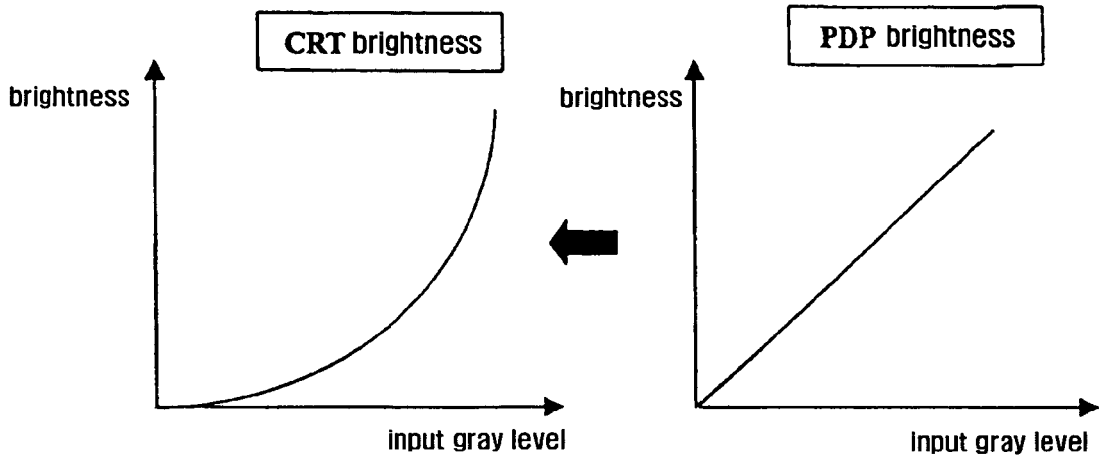
FIG. 3 is a graph showing a comparison result of brightness characteristics between a plasma display apparatus and a CRT.
Figure 4:
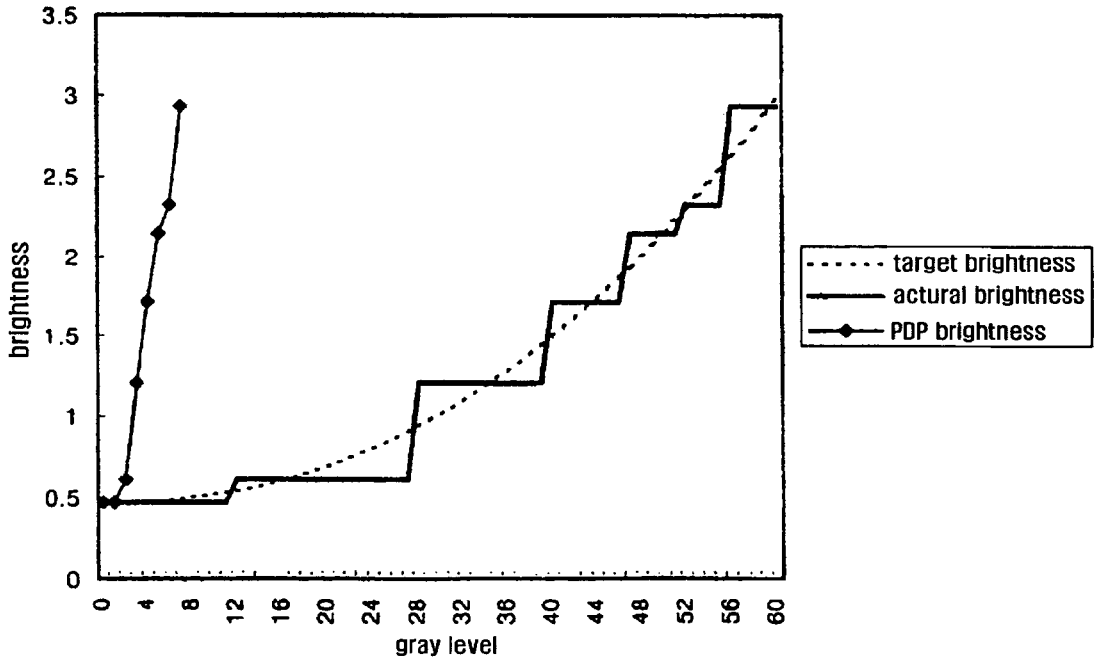
FIG. 4 is a graph showing inverse gamma correction in the conventional plasma display apparatus.
Figure 5A:
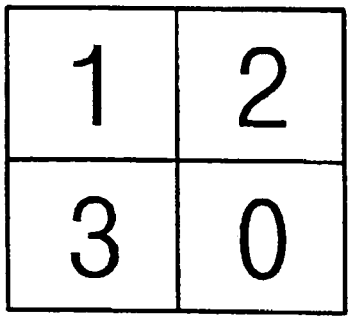
FIGS. 5*a* and 5*b* are views illustrating a dithering method of a plasma display panel in the prior art.
Figure 5B:
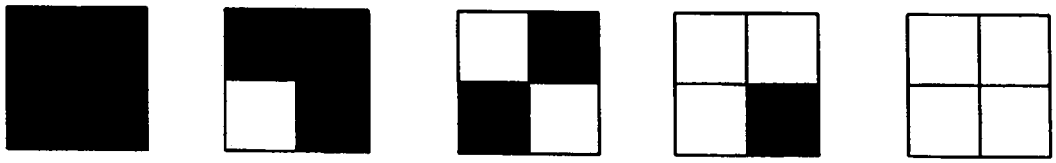
Figure 6:
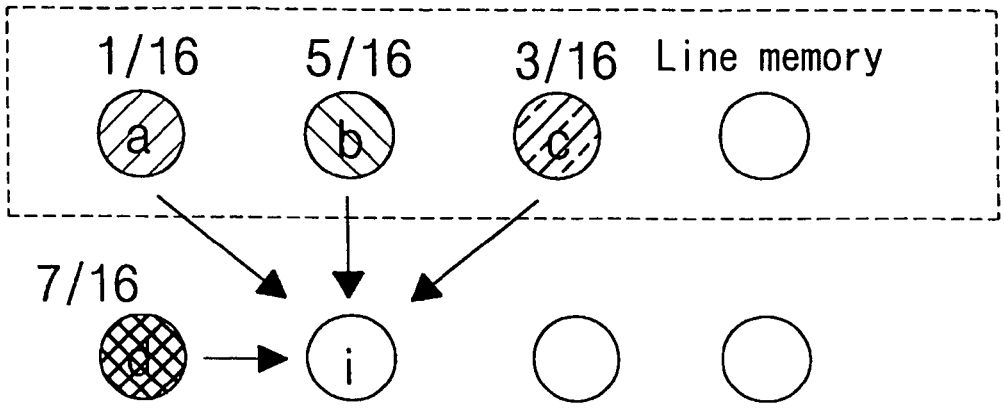
FIG. 6 is a view illustrating an error diffusion method of a plasma display apparatus in the prior art.
Figure 7:
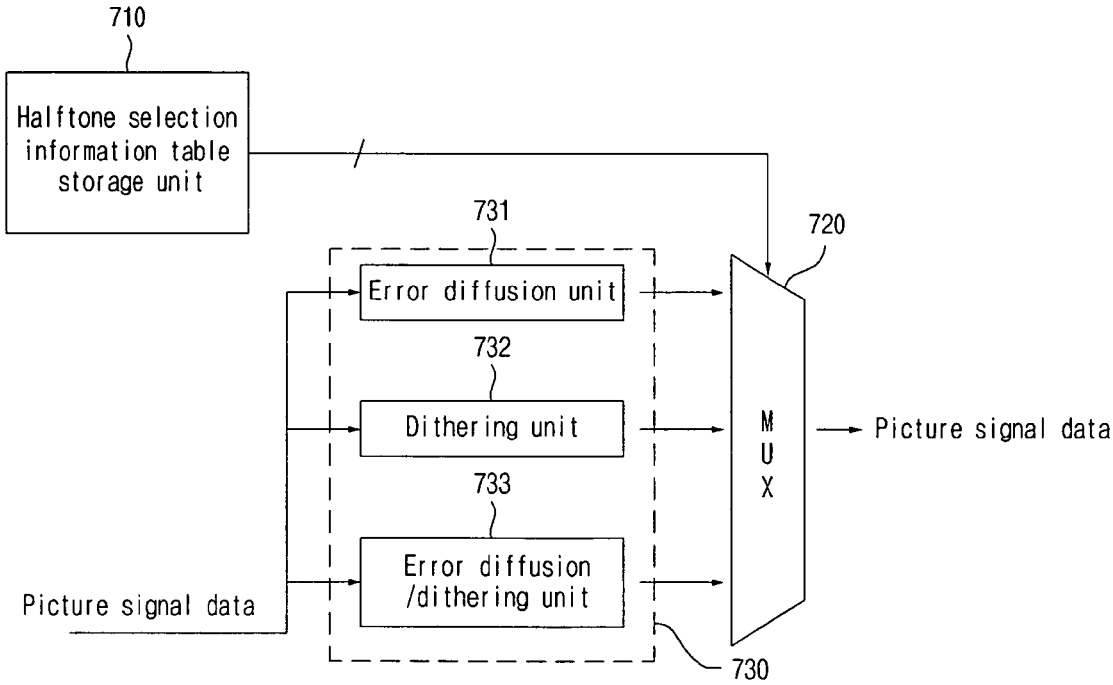
FIG. 7 is a block diagram showing a conventional halftoning unit.
Figure 8:
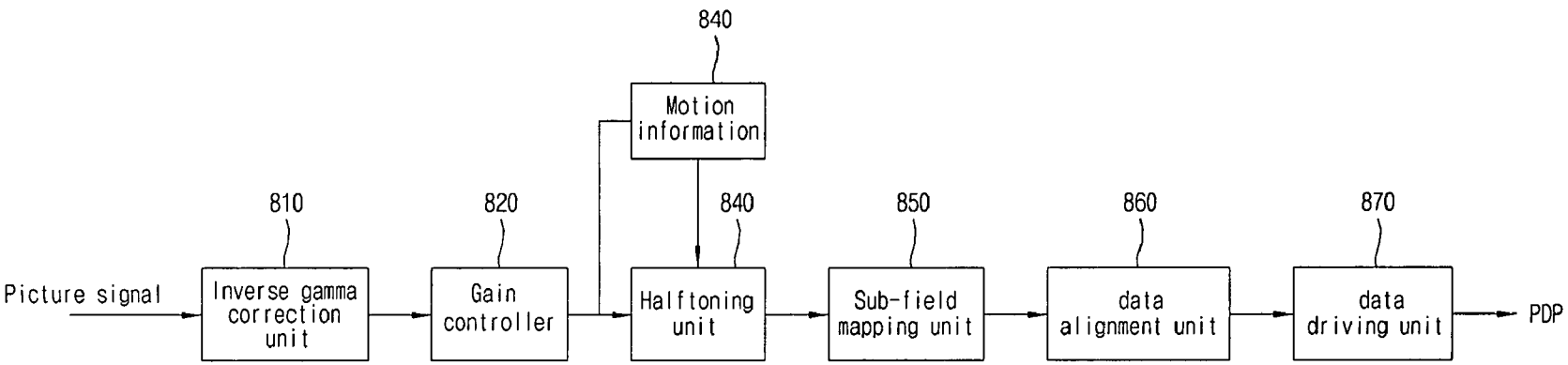
FIG. 8 is a block diagram showing a plasma display apparatus according to a first embodiment of the present invention.

FIG. 8 is a block diagram showing a plasma display apparatus according to a first embodiment of the present invention.

Referring to FIG. 8, the plasma display apparatus according to a first embodiment of the present invention includes an inverse gamma correction unit 810, a gain controller 820, a motion detection unit 830, a halftoning unit 840 and a sub-field mapping unit 850.

The inverse gamma correction unit 810 linearly converts a brightness value that is displayed depending upon a gray level value of an input image signal by performing inverse gamma correction on input image signal data.

The gain controller 820 controls gains for red (R), green (G) and blue (B) by multiplying R, G and B picture signals which are inverse gamma corrected by the inverse gamma correction unit 810 by gain values that can be controlled by a user or a set maker. In this case, the user or the set maker can set a desired color temperature through the gain controller 820.

The motion detection unit 830 detects motion information of the input image signal data. The motion picture consists of variations in a turn on or off state of a cell of one frame and a cell of a next frame and variations in a gray level. The motion information can also be detected through variations in the turn on/off of these cells and variations in the gray level.

Accordingly, the motion detection unit 840 according to a first embodiment of the present invention determines whether a motion has been generated by comparing gray level values of image signal data corresponding to respective cells in at least two or more consecutive frames, and detects the degree on how much is a motion generated.

Further, the motion detection unit 840 according to a first embodiment of the present invention can detect whether a motion has occurred or one or more information of the motion degree by measuring variations in the turn on/off state of each cell in at least two or more consecutive frames that are substantially driven after image signal data processing.

The halftoning unit 840 halftones the image signal data received from the gain controller 820 by using at least one or more of the dithering method and the error diffusion method according to motion information on whether a motion has occurred or the motion degree, which is received from the motion detection unit 830. It is thus possible to finely control brightness values displayed according to gray level values of image signal data, and also to improve the ability to represent gray levels.

To this end, the plasma display apparatus according to a first embodiment of the present invention includes a halftone selection information table storage unit (not shown) in which halftone methods depending upon motion information are set. The halftoning unit 840 will be described in more detail later on.

The sub-field mapping unit 850 maps the picture signals received from the halftone unit 840 to a predetermined sub-field mapping table.

The data alignment unit 860 aligns spatially aligned sub-field mapping data, which are received from the sub-field mapping unit 850, as temporal data.

The data driving unit 870 receives the data, which are temporally aligned by the data alignment unit 860, and supplies an address driving pulse to address electrodes (not shown) of a plasma display panel, thereby implementing an image of the plasma display panel. The operation of the halftoning unit 840 according to a first embodiment of the present invention will now be described with reference to FIG. 9.

Figure 9:
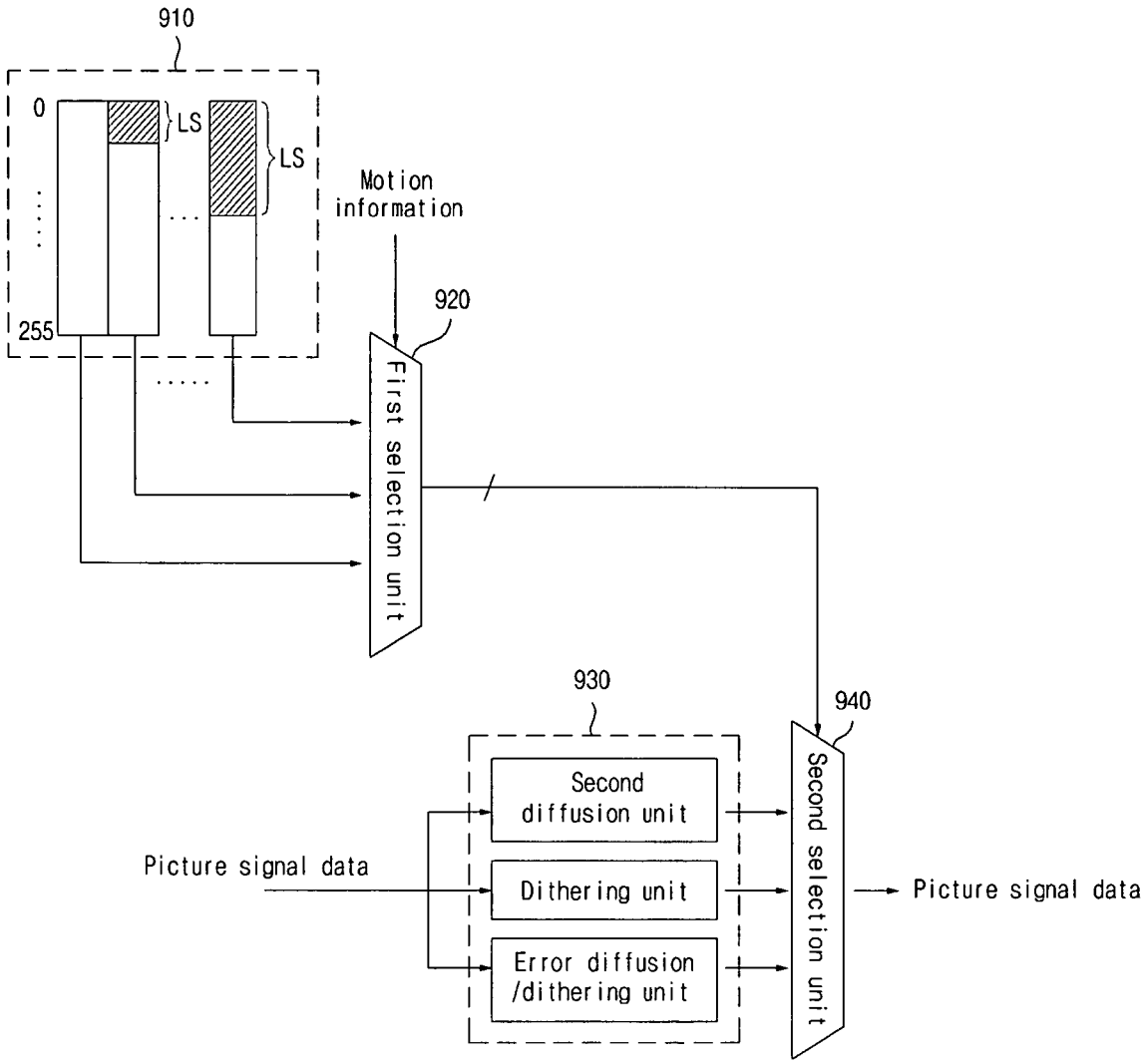
FIG. 9 is a detailed block diagram showing the construction of a halftoning unit according to a first embodiment of the present invention.

FIG. 9 is a detailed block diagram showing the construction of the halftoning unit according to a first embodiment of the present invention.

Referring to FIG. 9, the halftoning unit according to a first embodiment of the present invention includes a halftone selection information table storage unit 910, a first selection unit 920, a halftoning processing unit 930 and a second selection unit 940.

The halftone selection information table storage unit 910 stores at least two or more halftone selection information tables in which halftone methods are set according to motion information or one or more information of gray level values of image signal data. In a first embodiment of the present invention, since the halftone selection information table storage unit 910 is provided, input image signal data can be processed in real time. In this case, a low gray level region LS can be set differently every table. This will be described in detail with reference to FIG. 10.

The first selection unit 920 selects a halftone method based on motion information received from the motion detection unit 830. That is, the first selection unit 920 selects a halftone method corresponding to motion information, which is received from the motion detection unit 830, from the halftone selection information tables downloaded from the halftone selection information table storage unit 910.

The halftoning processing unit 930 halftones the image signal data received from the gain controller 820 by means of the dithering method, the error diffusion method and a mixture of dithering and error diffusion.

The second selection unit 940 selects and outputs image signal data that are processed in the halftoning processing unit 930 according to halftone method information output from the first selection unit 920.

In this case, each of the first selection unit 920 and the second selection unit 940 includes a multiplexer.

FIG. 10 is a view for explaining halftone selection information tables according to a first embodiment of the present invention.

As shown in FIG. 10, the halftone selection information tables according to a first embodiment of the present invention have different halftone methods set in according to gray level values of image signal data.

For example, in low gray levels, if the dithering method is used, lots of flicker noise is generated since dither mask patterns are repeatedly used. Therefore, in low gray levels, the error diffusion method is not used. Further, in non-low gray levels, a mixture of error diffusion and dithering is used so as to reduce error diffusion patterns. In this case, the term "low gray level" refers to a gray level having a low gray level value among image signal data. Generally, 16 or less gray levels among 256 gray levels from 0 to 255 are referred as a low gray level.

Furthermore, the halftone selection information table according to a first embodiment of the present invention has different halftone methods set in for the same gray level value of image signal data according to motion information.

For example, in a dithering method, the degree of noise, which is represented in a still image and a motion picture, is different according to dither mask patterns. Accordingly, in a still image, the dithering method and the error diffusion method are used, but a dither mask that can reduce dithering noise generated due to the still image, i.e., dither mask pattern noise is used. In a motion picture, the dithering method is used, but a dither mask that can reduce dithering noise generated due to the motion picture, i.e., false color is used. More particularly, in a motion picture having a high motion degree, an error diffusion pattern is rarely visible with the naked eye. Therefore, image signal data are halftoned by means of the error diffusion method.

As such, in a first embodiment of the present invention, a halftone method is decided according to two kinds of factors, motion information and a gray level value. That is, the halftone selection information table storage unit 910 includes a plurality of tables in which halftone methods are set according to the motion degree, wherein each of the tables has a halftoning method corresponding to each gray level value set in.

In a first embodiment of the present invention, as described above, when the motion degree is high and in the case of a low gray level in each of the two factors of motion information and a gray level value, the error diffusion method is used. That is, when a gray level value of image signal data is a predetermined threshold value or less, image signal data are determined as a low gray level, and are halftoned by means of the error diffusion method.

In this case, in a first embodiment of the present invention, considering motion information simultaneously with a gray level value, the greater the motion degree of motion information of image signal data becomes, the higher the threshold value becomes. Thus, as a motion is greater, a low gray level region is more expanded, and in the low gray level region, halftoning is performed by means of the error diffusion method. From FIG. 10, it can be seen that a low gray level region having tables corresponding to higher motions is expanded.

As such, in a first embodiment of the present invention, halftone noise can be reduced through differentiation of halftoning methods depending upon motion information of image signal data. The reliability of halftoning can also be secured considering motion information in selecting a halftone method.

Second Embodiment

Figure 11:
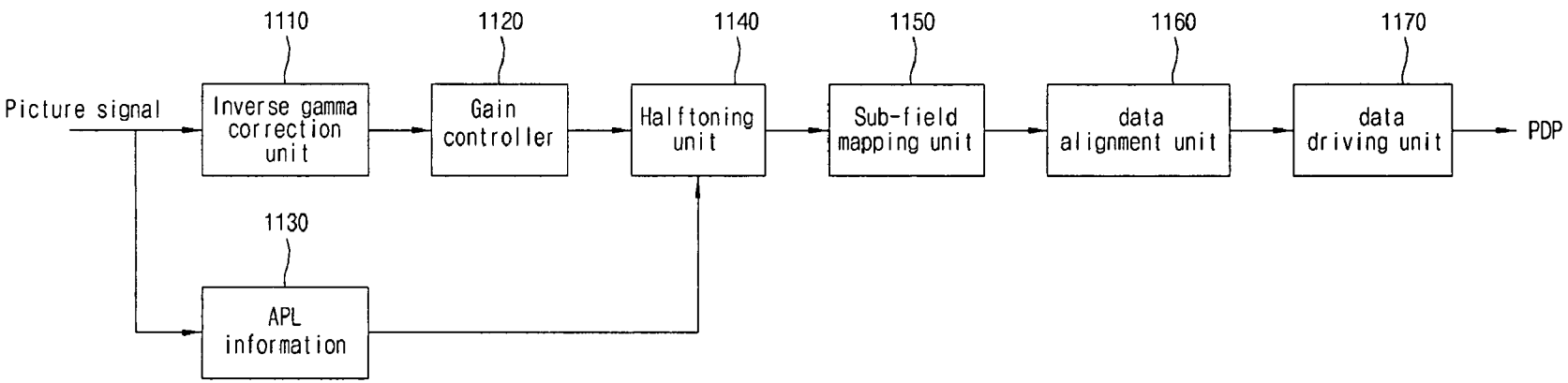
FIG. 11 is a block diagram showing a plasma display apparatus according to a second embodiment of the present invention.

FIG. 11 is a block diagram of a plasma display apparatus according to a second embodiment of the present invention.

Referring to FIG. 11, the plasma display apparatus according to a second embodiment of the present invention includes an inverse gamma correction unit 1110, a gain controller 1120, an APL detection unit 1130, a halftoning unit 1140 and a sub-field mapping unit 1150.

The inverse gamma correction unit 1110 linearly converts a brightness value that is displayed depending upon a gray level value of an input image signal by performing inverse gamma correction on input image signal data.

The gain controller 1120 controls gains for red (R), green (G) and blue (B) by multiplying R, G and B picture signals which are inverse gamma corrected by the inverse gamma correction unit 1110 by gain values that can be controlled by a user or a set maker. In this case, the user or the set maker can set a desired color temperature through the gain controller 1120.

The APL detection unit 1130 detects APL (Average Picture Level) information by calculating APL values of gray level values of image signal data corresponding to the entire cells on a frame basis.

Generally, the plasma display apparatus has high power consumption since it uses a high voltage. In order to save power consumption, the APL detection unit 1130 is used to allocate different weights of the number of sustain pulses, which are applied in a sustain period, according to APL values whereby power consumption is kept to a predetermined level. In a second embodiment of the present invention, the reliability is secured in selecting a halftoning method using APL information output from the APL detection unit 1130 having this function.

The halftoning unit 1140 halftones image signal data received from the gain controller 1120 by using at least one or more of the aforementioned dithering method and the error diffusion method according to information of an APL value received from the APL detection unit 1130. It is thus possible to finely control brightness values displayed according to gray level values of image signal data and also to improve the ability to represent gray levels.

To this end, the plasma display apparatus according to a second embodiment of the present invention includes a halftone selection information table storage unit (not shown) in which halftone methods depending upon APL information are set. The halftoning unit 1140 will be described in more detail later on.

The sub-field mapping unit 1150 maps the picture signals received from the halftone unit 1140 to a predetermined sub-field mapping table.

The data alignment unit 1160 aligns spatially aligned sub-field mapping data, which are received from the sub-field mapping unit 1150, as temporal data.

The data driving unit 1170 receives the data, which are temporally aligned by the data alignment unit 1160, and supplies an address driving pulse to address electrodes (not shown) of a plasma display panel, thereby implementing an image of the plasma display panel. The operation of the halftoning unit 1140 according to a second embodiment of the present invention will now be described with reference to FIG. 12.

Figure 12:
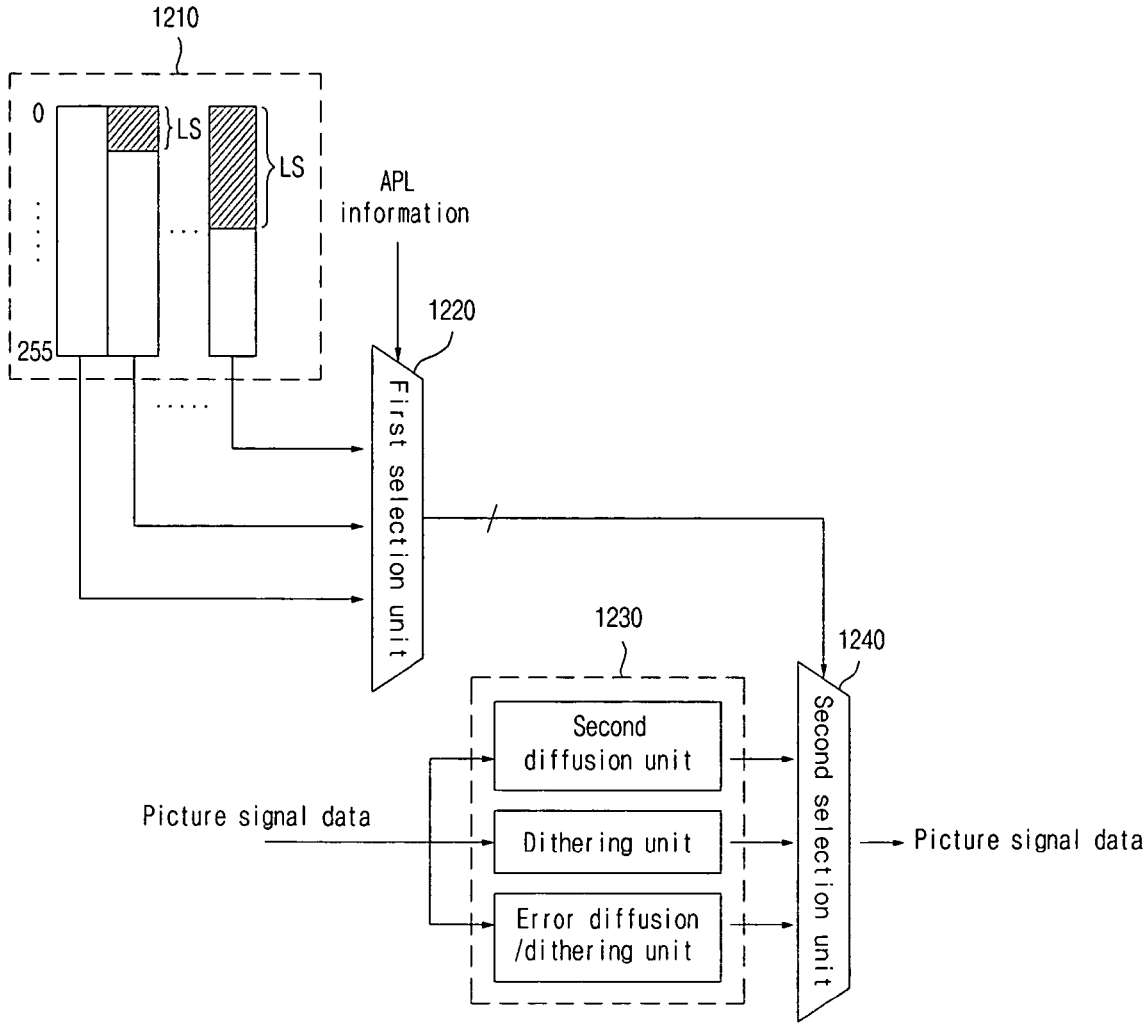
FIG. 12 is a detailed block diagram showing the construction of the halftoning unit according to a second embodiment of the present invention.

FIG. 12 is a detailed block diagram showing the construction of the halftoning unit according to a second embodiment of the present invention.

Referring to FIG. 12, the halftoning unit according to a second embodiment of the present invention includes a halftone selection information table storage unit 1210, a first selection unit 1220, a halftoning processing unit 1230 and a second selection unit 1240.

The halftone selection information table storage unit 1210 stores at least two or more halftone selection information tables in which halftone methods are set according to APL information or one or more information of gray level values of image signal data. In a second embodiment of the present invention, since the halftone selection information table storage unit 1210 is provided, input image signal data can be processed in real time. In this case, a low gray level region LS can be set differently every table. This will be described in detail with reference to FIG. 13.

The first selection unit 1220 selects a halftone method based on APL information received from the APL detection unit 1130. That is, the first selection unit 1220 selects a halftone method corresponding to APL information, which is received from the APL detection unit 1130, from the halftone selection information tables downloaded from the halftone selection information table storage unit 1210.

The halftoning processing unit 1230 halftones the image signal data received from the gain controller 1120 by means of the dithering method, the error diffusion method and a mixture of dithering and error diffusion, respectively.

The second selection unit 1240 selects and outputs image signal data that are processed in the halftoning processing unit 1230 according to halftone method information output from the first selection unit 1220.

In this case, each of the first selection unit 1220 and the second selection unit 1240 includes a multiplexer.

FIG. 13 is a view for explaining halftone selection information tables according to a second embodiment of the present invention.

As shown in FIG. 13, the halftone selection information tables according to a second embodiment of the present invention store halftone methods, which are differently set according to gray level values of image signal data. Description thereof has been given with reference to FIG. 10 of a first embodiment, and will be thus omitted for simplicity.

Furthermore, the halftone selection information tables according to a second embodiment of the present invention store halftone methods, which are differently set to the same gray level value of image signal data according to APL information.

For example, in the case where the dithering method is used, when comparing a dark screen having a low APL value and a bright screen having a high APL value, lots of dithering noise is generated in the dark screen. This is because the number of sustain pulses is great in a dark screen having a low APL value. Due to this, the error diffusion method is mainly used in a dark screen.

As such, in a second embodiment of the present invention, a halftone method is decided according to the two kinds of the factors including APL information and gray level value. That is, the halftone selection information table storage unit 1210 stores a plurality of tables in which halftone methods are set according to APL values, wherein a halftoning method corresponding to each of the gray level values is set in each of the tables.

In a second embodiment of the present invention, as described above, when an APL value is low and in the case of a low gray level in each of two factors of APL information and a gray level value, the error diffusion method is used. That is, when a gray level value of image signal data is a predetermined threshold value or less, image signal data are determined as a low gray level, and are halftoned by means of the error diffusion method.

In this case, in a second embodiment of the present invention, considering APL information simultaneously with a gray level value, the lower an APL value of image signal data becomes, the higher the threshold value becomes. Thus, as an APL value is lower, a low gray level region is more expanded, and in the low gray level region, halftoning is performed by means of the error diffusion method. From FIG. 13, it can be seen that a low gray level region having tables, which correspond to when an APL value is low, is expanded.

As such, in a second embodiment of the present invention, halftone noise can be reduced through differentiation of halftoning methods depending upon APL information of image signal data. The reliability of halftoning can also be secured considering APL information in selecting a halftone method.

Third Embodiment

Figure 14:
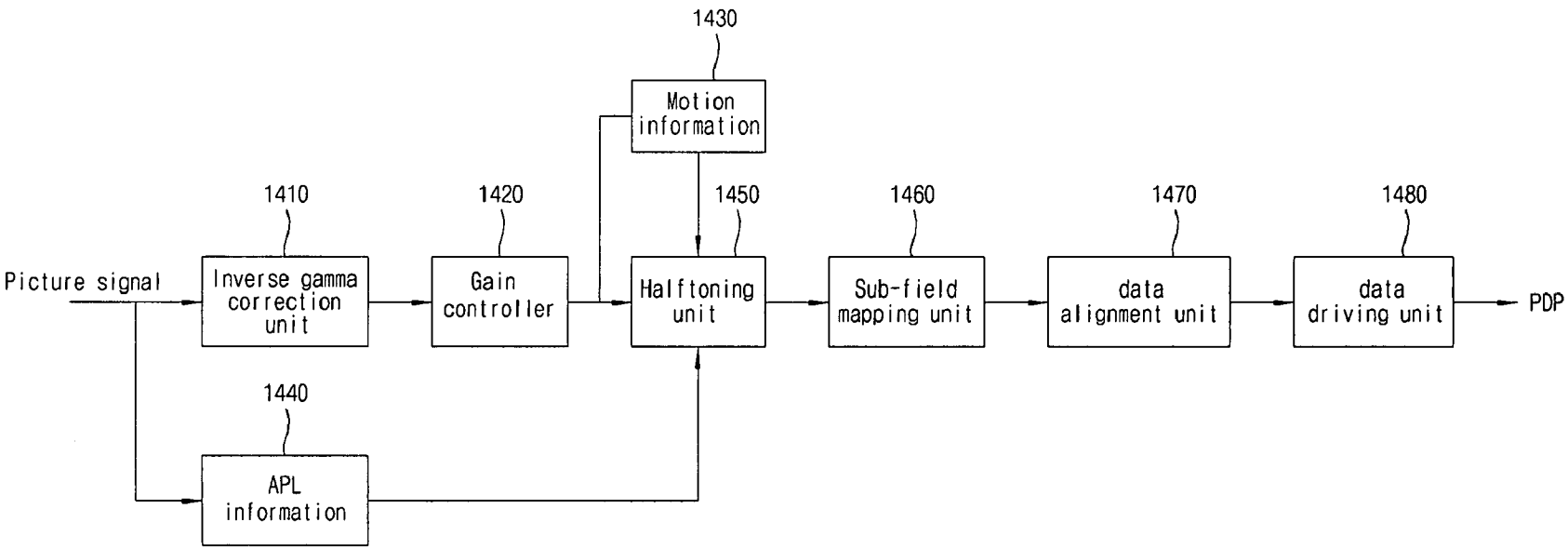
FIG. 14 is a block diagram showing a plasma display apparatus according to a third embodiment of the present invention.

FIG. 14 is a block diagram showing a plasma display apparatus according to a third embodiment of the present invention.

Referring to FIG. 14, the plasma display apparatus according to a third embodiment of the present invention include an inverse gamma correction unit 1410, a gain controller 1420, a motion detection unit 1430, an APL detection unit 1440, a halftoning unit 1450 and a sub-field mapping unit 1460.

The halftoning unit 1450 according to a third embodiment of the present invention halftones image signal data received from the gain controller 1420 by selectively using a halftone method according to motion information and APL information, which are received from the motion detection unit 1430 and the APL detection unit 1440, respectively.

The operation of each of the inverse gamma correction unit 1410, the gain controller 1420, the motion detection unit 1430, the APL detection unit 1440, the sub-field mapping unit 1460, the data alignment unit 1470 and the data driving unit 1480 has been described in first and second embodiments of the present invention. Description thereof will be thus omitted for simplicity.

FIG. 15 is a view for explaining halftone selection information tables according to a third embodiment of the present invention.

Referring to FIG. 15, the halftone selection information tables according to a third embodiment of the present invention store halftone methods, which are differently set according to gray level values of image signal data, APL information and motion information.

In a third embodiment of the present invention, the halftone selection information tables are generated by reflecting the halftone noise propensity depending upon two factors of motion information and APL information, as listed in the following Table 1.

TABLE 1

| Classification | Motion Information | APL Information | Halftone Noise |
|---|---|---|---|
| A | Degree of motion increase | APL value increase | Dithering noise increase |
| B | Degree of motion increase | APL value decrease | Dithering noise further increase |
| C | Degree of motion decrease | APL value increase | Error diffusion pattern increase |
| D | Degree of motion decrease | APL value decrease | Error diffusion pattern further increase |

Referring to FIG. 15 and Table 1, as the motion degree becomes great, a table in which information of a halftone method capable of reducing dither noise is set is selected. As the motion degree becomes small, a table in which information of a halftone method capable of reducing an error diffusion pattern is set is selected. Furthermore, in B of Table 1, when the motion degree is great and the APL value is low, dithering noise further increases. Thus, the error diffusion method is mainly used. That is, as described in the first and second embodiments, a low gray level region is set high. The error diffusion method is used in the low gray level region.

As such, in a third embodiment of the present invention, optimized image representation can be obtained using a proper halftone method according to motion information of image signal data and APL information.

As described above, according to embodiments of the present invention, halftone noise generated when implementing an image can be reduced by improving a plasma display apparatus and image processing method thereof. Therefore, there is an effect in that the ability to represent gray levels can be improved. There is also an effect in that the picture quality of a plasma display apparatus can be improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising:

a motion detection unit detecting motion information of input image signal data; and a halftoning unit performing halftoning the image signal data by using at least one or more of a dithering method and an error diffusion method according to the motion information received from the motion detection unit, wherein different halftone methods are set according to gray level values of the input image signal data, wherein when the gray level value is a predetermined threshold value or less, the image signal data are halftoned by means of the error diffusion method, wherein the greater the motion degree of motion information of the image signal data becomes, the higher the predetermined threshold value becomes.

2. The plasma display apparatus as claimed in claim 1, wherein the motion detection unit detects whether a motion exists or one or more information of the motion degree by comparing gray level values of image signal data corresponding to respective cells in at least two or more consecutive frames.

3. The plasma display apparatus as claimed in claim 1, wherein the motion detection unit detects whether a motion exists or one or more information of the motion degree by measuring variations in a turn on or off state of each cell in at least two or more consecutive frames.

4. The plasma display apparatus as claimed in claim 1, wherein the halftoning unit includes:

a first selection unit selecting a halftone method according to the motion information;

a halftoning processing unit performing halftoning the image signal data using each of the methods; and a second selection unit that selects and outputs image signal data, which are processed in the halftoning processing unit, according to information received from the first selection unit.

5. The plasma display apparatus as claimed in claim 1, wherein different halftone methods are set with respect to the same gray level value of image signal data according to the motion information.

6. The plasma display apparatus as claimed in any one of claims 1-4 or 5, further including a halftone selection information table storage unit that previously stores at least two or more halftone selection information tables in which halftone methods are set according to the motion information or any one or more information of gray level values of image signal data.

7. An image processing method of a plasma display apparatus, comprising:

detecting motion information of input image signal data; and halftoning the image signal data by using at least one or more methods of a dithering method and an error diffusion method according to the motion information, wherein different halftone methods are set according to gray level values of the input image signal data, wherein when the gray level value is a predetermined threshold value or less, the image signal data are halftoned by means of the error diffusion method, wherein the greater the motion degree of motion information of the image signal data becomes, the higher the predetermined threshold value becomes.

8. The image processing method as claimed in claim 7, wherein the motion detection step includes detecting whether a motion exists or one or more information of the motion degree by comparing gray level values of image signal data corresponding to respective cells in at least two or more consecutive frames.

9. The image processing method as claimed in claim 7, wherein the motion detection step includes detecting whether a motion exists or one or more information of the motion degree by measuring variations in a turn on or off state of each cell in at least two or more consecutive frames.

10. The image processing method as claimed in claim 7, wherein the halftoning step includes:

a first selection step that selects a halftone method according to the motion information;

a halftoning processing step of halftoning the image signal data using each of the methods; and a second selection step of selecting and outputting image signal data, which are processed in the halftoning processing step, according to information received from the first selection step.

11. The image processing method as claimed in claim 7, wherein different halftone methods are set with respect to the same gray level value of image signal data according to the motion information.

12. The image processing method as claimed in any one of claims 7-10 or 11, further including a halftone selection information table storage unit that previously stores at least two or more halftone selection information tables in which halftone methods are set according to the motion information or any one or more information of gray level values of image signal data.

* * * * *